United States Patent [19]

Thompson et al.

[11] 4,057,156

[45] Nov. 8, 1977

[54] LIFTING ARM APPARATUS

[75] Inventors: Vern C. Thompson, Minneapolis; John A. Riggle, Minnetonka, both of Minn.

[73] Assignee: Reuter, Inc., Hopkins, Minn.

[21] Appl. No.: 666,886

[22] Filed: Mar. 15, 1976

[51] Int. Cl.[2] ..... B65F 3/02

[52] U.S. Cl. ..... 214/302; 214/313; 214/670; 214/711

[58] Field of Search ..... 214/147 G, 302, 303, 214/313, 312, 315, 711, 701 P, 650 SG, 670, 672

[56] References Cited

U.S. PATENT DOCUMENTS

| | | | |
|---|---|---|---|
| 2,592,324 | 4/1952 | Oliver | 214/302 |
| 3,868,033 | 2/1975 | Le Duff | 214/313 |
| 3,910,434 | 10/1975 | Ebeling et al. | 214/302 |
| 3,944,092 | 3/1976 | Ebeling et al. | 214/302 |

*Primary Examiner*—Lawrence J. Oresky

*Attorney, Agent, or Firm*—Merchant, Gould, Smith, Edell, Welter & Schmidt

[57] ABSTRACT

A trash collecting system, apparatus, and method in which a vehicle approaches, reaches for, grasps, raises along its side, and inverts into its body a sequence of containers conveniently located at ground level, returning each container to its original position. The raising mechanism is hydraulically actuated, and the engagement with the containers is pneumatic.

6 Claims, 17 Drawing Figures

HYD. MOTOR
RESTRICTOR
ACCUMULATOR
V. REL.
1000 PSI
1500 PSI
2500 PSI
200 PSI
V. CK.
MP
PP
RESERVOIR
203

LIFTING ARM APPARATUS

BACKGROUND OF THE INVENTION

This invention relates to the field of materials handling, and particularly to a system, apparatus, and method for use in transferring material, which has been collected in separate containers located strategically at ground level, to the body of a vehicle, for transportation, the containers being returned to their original positions for refilling. The field of trash collection, which is an intended use of the invention, is extensively worked, and systems are known for emptying a container into a vehicle from the front, from the rear, and from the side.

SUMMARY OF THE INVENTION

The invention is shown in a side-loading application to facilitate using the system along relatively narrow aisles or alleys. It requires no manipulation of the container by the human operator, nor any preliminary dumping of material into a container permanently carried by the vehicle. Inversion of the container does not begin until it has been lifted beside the vehicle to an appropriate height adjacent an opening in the vehicle, thus avoiding spillage. The container is lifted from and replaced at its location automatically and gently, using pneumatic engagement which involves minimum damage to containers. All other operations are hydraulic, and are under the operator's regular and emergency control at all times.

Various advantages and features of novelty which charcterize our invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figure 1:
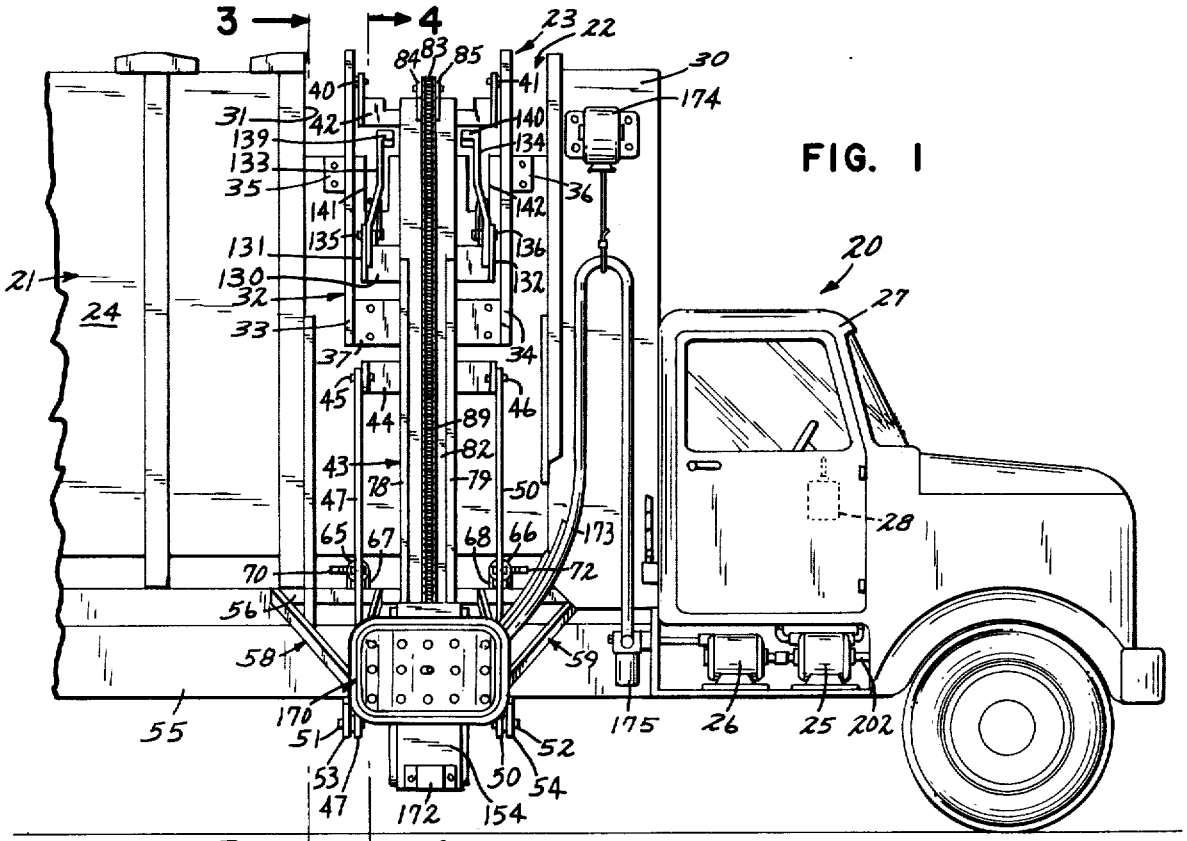
FIG. 1 is a front elevation of apparatus according to our invention mounted on a vehicle.

The drawing shows a trash collecting vehicle 20 having a body 21 with at least a partial top opening 22, the body having loading apparatus 23 mounted on the outer surface of one wall 24 thereof. In addition to its usual functions, the engine, not shown, of the vehicle drives a hydraulic pumping arrangement, suggested at 25, and a vacuum pump 26. The hydraulic and vacuum lines are controlled by manual actuators located within the cab 27, as suggested at 28. A portion 30 of body 21 forward of loading apparatus 23 preferably includes suitable compacting means of any conventional nature, not shown, for displacing rearwardly material deposited in body 21 by apparatus 23.

A portion of the wall 24 of the body 21 is cut away at the top, as shown at 22, in the area where apparatus 23 is located. Track means 32 including a pair of channel members 33 and 34 are secured to wall 24 by mounting plates 35, 36 and 37. Members 33 and 34 are parallel and extend vertically, and their concavities are in apposition.

A pair of wheels 40 and 41 are spaced along a common axis to travel in channel members 33 and 34, and are carried rotatively by an upper cross member 42 secured transversely to the back of an elongated arm or track member 43 near its upper end. A second similar cross member 44 secured transversely to track member 43 near its center is pivotally connected at 45 and 46 to the upper ends of a pair of levers 47 and 50: the lower ends of levers 47 and 50 are pivotally connected at 51 and 52 to the outer ends of a pair of horizontal bars 53 and 54 having their inner ends suitably secured to the frame 55 of the vehicle, and supported near points 51 and 52 by a bracket structure including a base 56 secured to frame 55 as by fasteners 57, and a pair of weldments 58 and 59, each comprising a pair of diagonal members 60 and 61 terminating in a projection 62 secured to the horizontal bar by a suitable fastener 63.

Figures 4, 5:
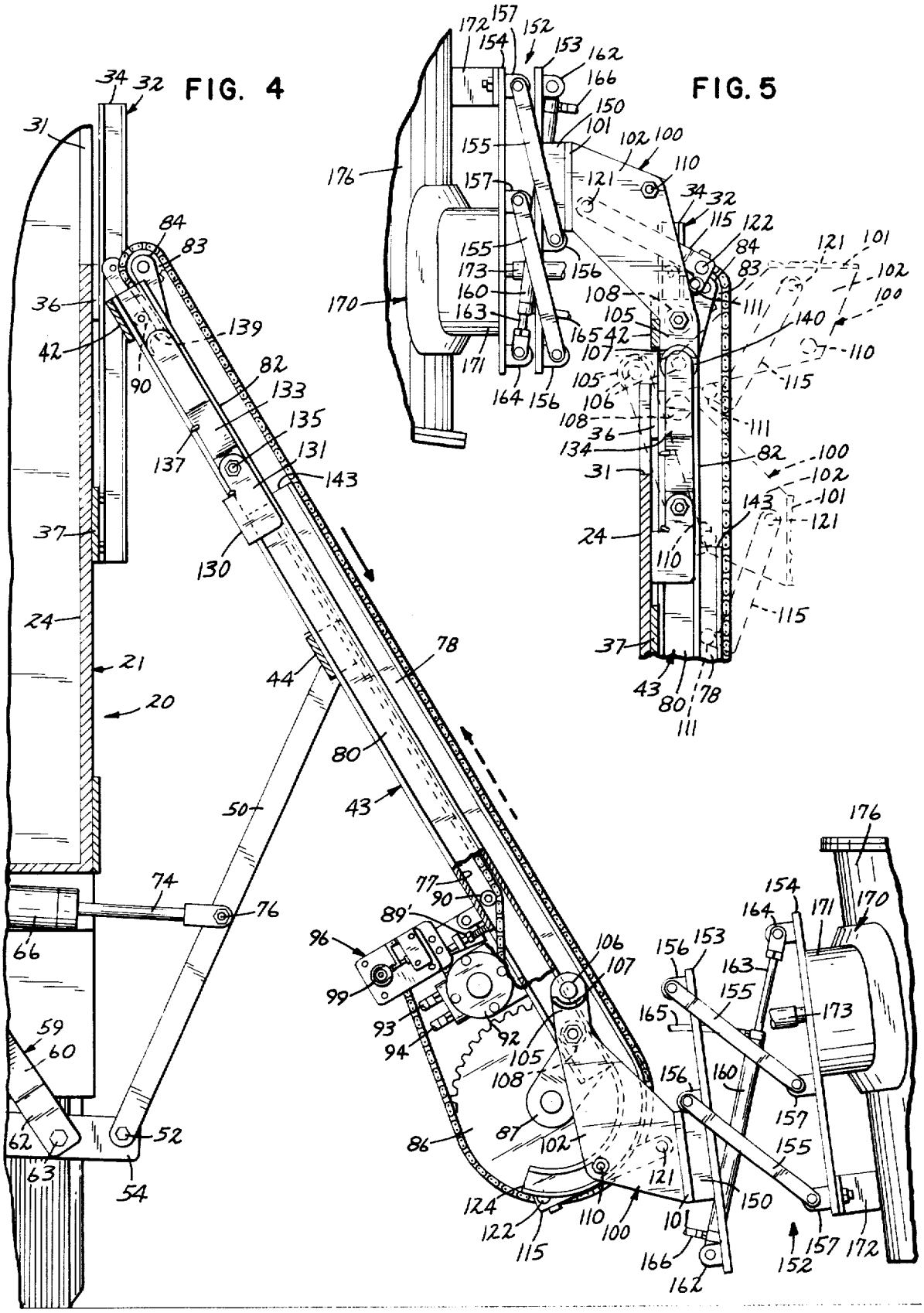
FIG. 4 is a view similar to FIG. 3 as seen from the lines 4—4 of FIG. 1 showing the apparatus in a different position.
FIG. 5 is a fragmentary view of the same structure in a still different position.

A pair of linear fluid motors 65 and 66 are pivotally secured to brackets 67 and 68 fastened to frame 55, and have hydraulic connections 69 and 70, 71 and 72. The actuators 73 and 74 of the cylinders are pivoted to intermediate fulcrum points 75 and 76 on levers 47 and 50. It will be evident that as actuators 73 and 74 extend, levers 47 and 50 are pivoted about points 51 and 52, and the lower end of track member 43 is angulated away from a normal vertical "travel" position beside wall 24, as shown in FIG. 4, the upper end of the track member being maintained in position laterally but allowed to move downwardly by track means 32. Reverse operation of the actuator restores the track member to its original position.

Figure 10:
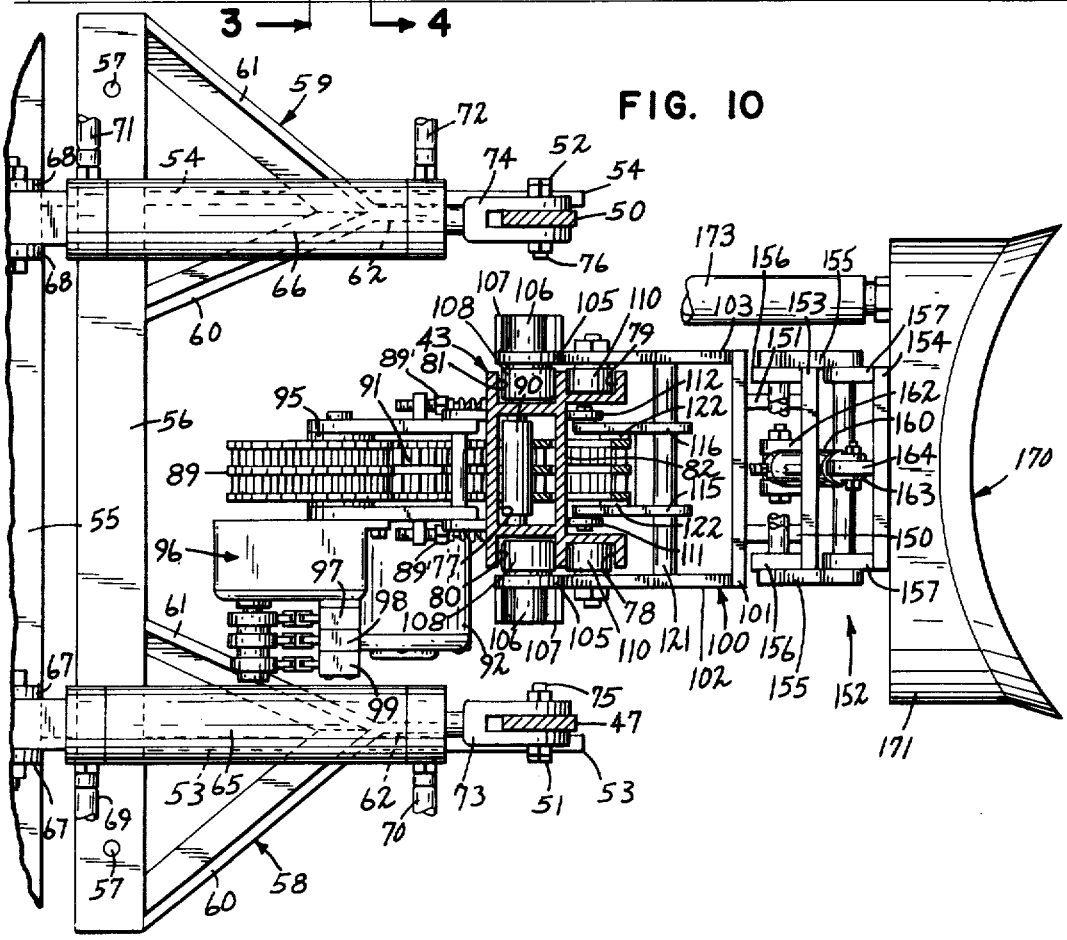
FIG. 10 is a view seen along the line 10—10 of FIG. 3, to a larger scale.
Figure 6:
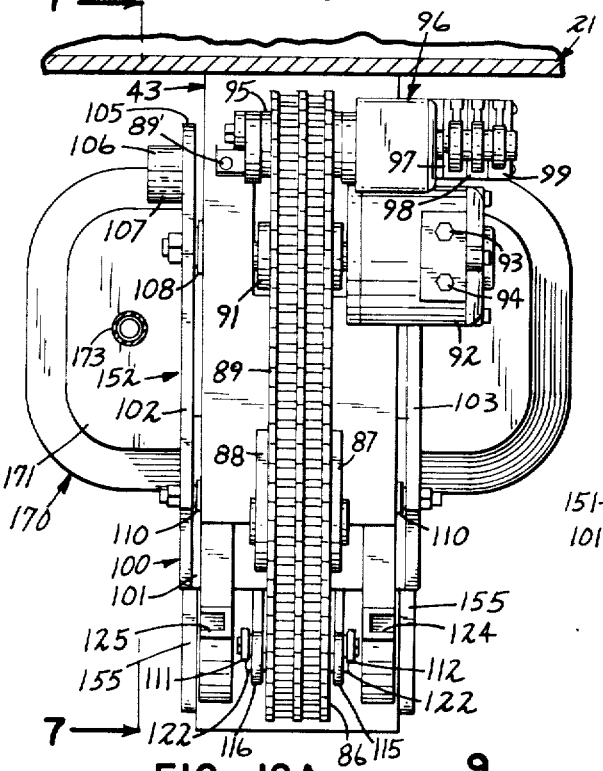
FIG. 6 is a fragmentary view of the invention seen from the line 6—6 of FIG. 3, to a larger scale.
Figure 9:
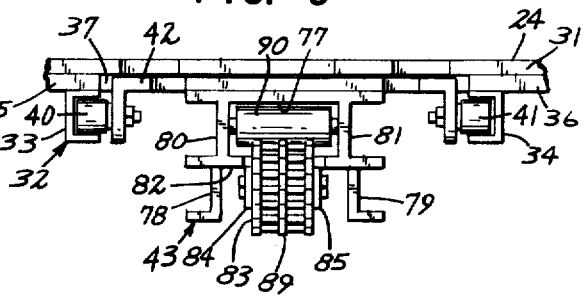
FIG. 9 is a view seen along the line 9—9 of FIG. 2.

Track member 43 (see FIG. 9) is an elongated casting or box weldment formed to provide a central enclosed channel 77, a first, outer pair of guidance surfaces 78 and 79 in the form of channels, a second, inner pair of guidance surfaces 80 and 81 also in the form of channels, and a bearing surface 82. A small sprocket wheel 83 is rotatably mounted in brackets 84 and 85 at the upper end of track member 43, and a larger sprocket wheel 86 is similarly mounted at the bottom of the track member in brackets 87 and 88. An endless chain 89, shown schematically in FIG. 1 and more pictorially in FIGS. 6, 9, and 10, passes around sprocket wheels 86 and 83, over guide rollers 90 in channel 77, and then under the driving pulley 91 of a positive displacement rotary fluid motor 92 having fluid connections 93 and 94, and over the driven pulley 95 of a control mechanism 96, suitable chain take up adjustments 89' being provided. Control mechanism 96 includes a plurality of cam actuated valves 97, 98, and 99 to control the speed and travel of chain 89, as will be more fully described in connection with FIG. 11.

A carriage 100 is arranged to move along track member 43, and comprises a saddle 101 and left and right side panels 102 and 103: since the latter are mirror images, only one will be described in detail. Panel 102 comprises a quadrilateral body with a tab 105 projecting from one corner to carry stop means in the form of a pin 106 and an outwardly convex cylindrical ledge 107 concentric therewith and spaced therefrom. Near that corner, a roller 108 is rotatively mounted on the inner surface of the panel. Near an adjoining corner, a second roller 110 is similarly rotatively mounted. A line passing through the axis of pin 106 and the axis of roller 108 does not pass through the axis of roller 110, which is displaced therefrom by a predetermined amount equal to the distance between the centers of guidance surfaces 78 and 80 of track member 93. Thus carriage 100 includes a pair of pins 106 having a common axis, a first pair of rollers 108 having another common axis, and a second pair of rollers 110 having a third common axis, the common axes being parallel but not all in the same plane. A further common axis of interest is that of a pair of rollers 111 and 112, carried on a pair of levers 115 and 116, which are connected to a shaft 121 for rotation about a further axis parallel to and spaced from the common axes previously recited. Levers 115 and 116 are pivotally connected at points displaced from 111 and 112, as at 122, to chain 89, so that movement of the chain constrains the carriage to move along the track member.

Figure 7:
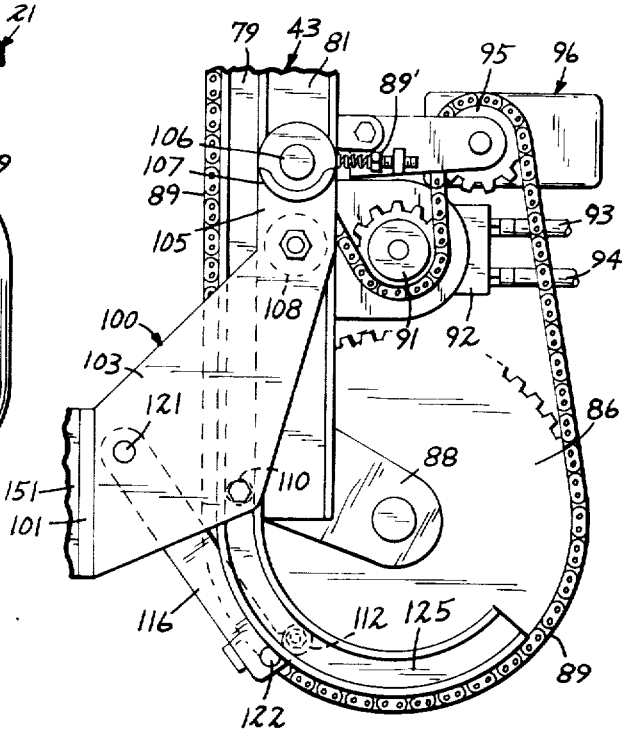
FIG. 7 is a fragmentary view seen along the lin 7—7 of FIG. 6.
Figure 3:
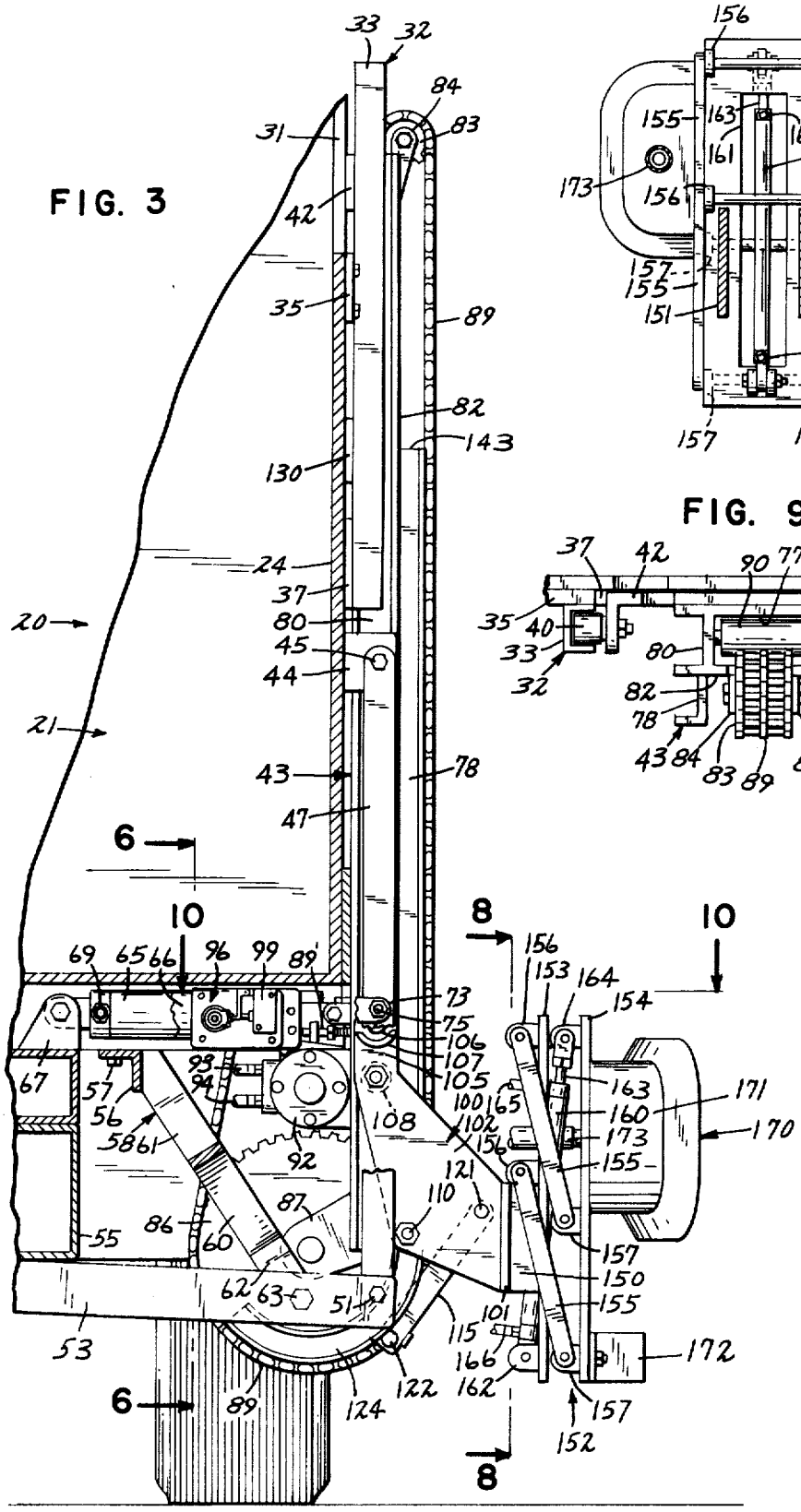
FIG. 3 is a view of the structure of FIG. 1 to a larger scale, as seen from the line 3—3 of FIG. 1, parts being omitted or broken away for clarity o illustration and portions of the vehicle being shown in section.
Figure 8:
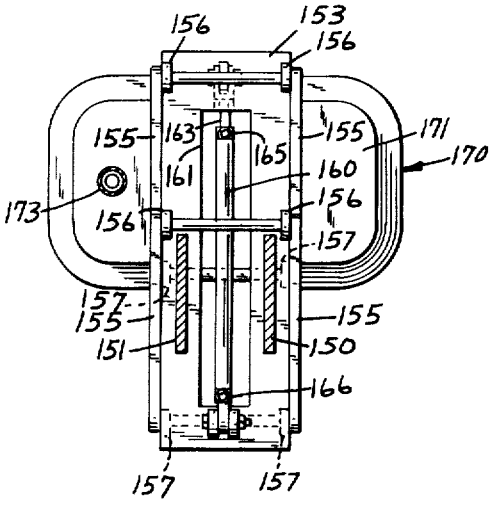
FIG. 8 is a view seen along the line 8—8 of FIG. 3 to the same scale.

Because of the geometrical relationships recited, saddle 101 will remain parallel to itself throughout motion of the carriage along the track member as long as the guidance surfaces are rectilinear. Reference to FIGS. 3, 4, and 7 will make it clear that while guidance surfaces 80 and 81 are rectilinear from end to end, the lower ends 124 and 125 of guidance surfaces 76 and 77 curve around the lower ends of surfaces 80 and 81. When rollers 110 move along the curved portions of surfaces 76 and 77, saddle 101 changes it angulation instead of remaining parallel to itself as it moves.

Further stop means is provided to cooperate with pins 106 and ledges 107. To this end, a further cross member 130 is secured to track member 43, and includes a pair of brackets 131 and 132 to which a pair of arms 133 and 134 are pivoted at 135 and 136. Resilient means such as a pair of springs 137 and 138 normally maintain arms 133 and 134 parallel to the guidance surfaces of track member 43. The free ends of arms 133 and 134 are provided with stops in the form of downwardly concave cylindrical segments 139 and 140, having inner and outer radii substantially the same as the outer radii of pins 106 and the inner radii of ledges 107, respectively. Portions of wall 24 in line with arms 133 and 134 may be cut away as at 141 and 142. The upper portions of guidance surfaces 78 and 79 are cut away at 143 and 144.

Mounted on saddle 101 in any suitable manner as by blocks 150 and 151 is a parallel linkage 152 comprising a pair of spaced parallel plates 153 and 154 joined by parallel links 155 pivoted to ears 156 on plage 153 and ears 157 on plate 154. A linear fluid motor 160 passes through an opening 161 in plate 153 and is pivoted thereto at a bracket 162 to expand and contract the linkage. The actuator 163 of motor 160 is pivotally connected to plate 154 at a bracket 164. Hydraulic connections are made to motor 160 at 165 and 166.

Mounted on plate 154 is a pickup head 170 which in general terms comprises one or more vacuum heads 171 and may include a bumper 172. A suitable flexible conduit 173 makes connection between vacuum head 171 and vacuum pump 26, and may be supported at a location between its ends by a suitable arrangement indicated generally at 174. The vacuum line may include a conventional liquid trap 175 if desired.

Reference numeral 176 identifies a container suitable for use with loading apparatus 23. It may be made of some material which is sturdy and light, and which has a smooth outer surface: we have found various plastics, such as polypropylene and polyethylene, to be a very satisfactory material for this use. It is convenient for the container to taper slightly to permit nesting empty containers to conserve storage space. If conditions of exposure require, the containers may be provided with hinged covers. It will be appreciated that the configuration of member 171 is made to conform to the containers to be used, being flat if the containers are flat surfaced, and having appropriate curvatures to accept cylindrical or conical containers if such are used.

Figure 11:
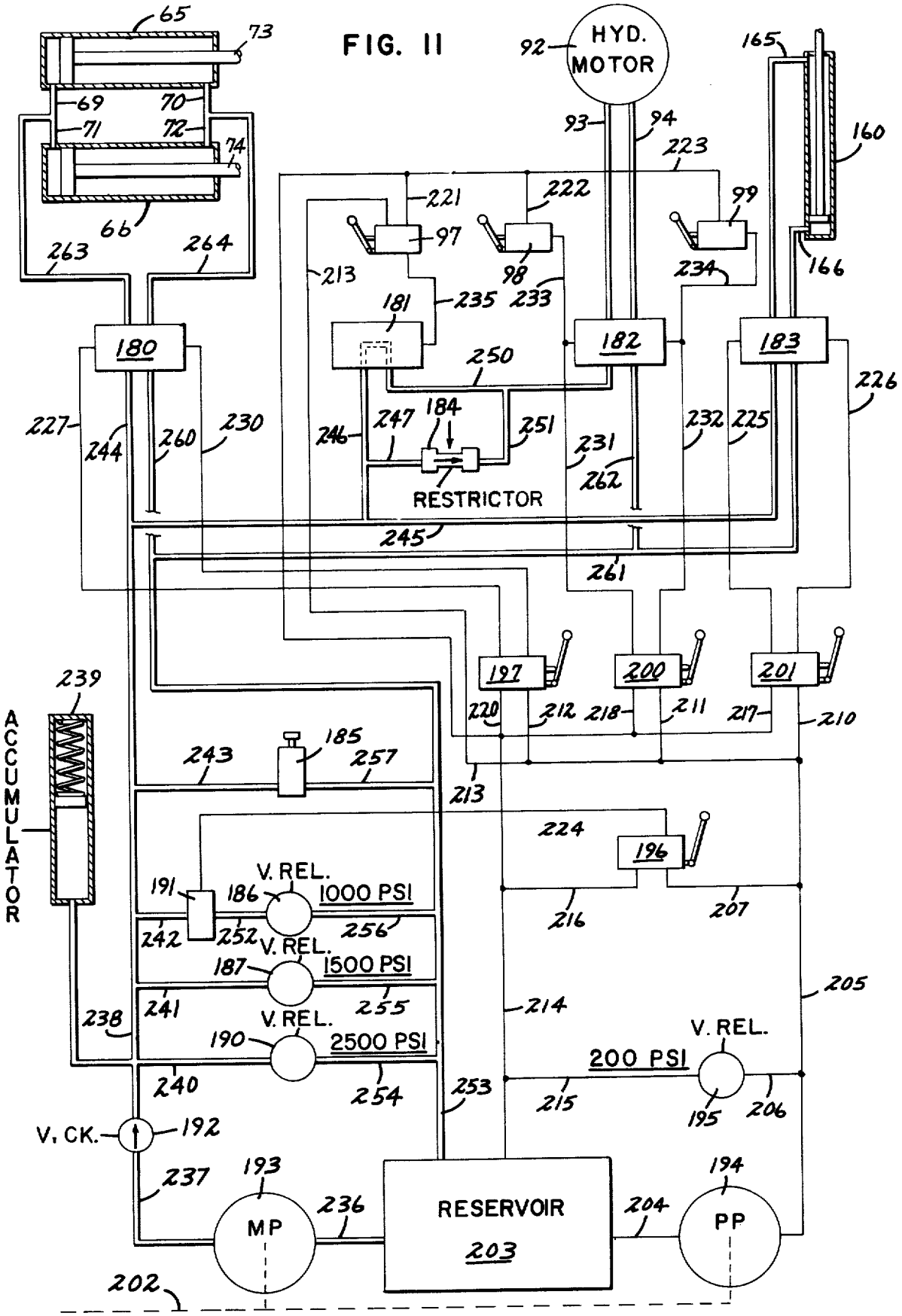
FIG. 11 is a schematic showing of hydraulic conduitry used in the invention.

Turning now to FIG. 11, the hydraulic system of our invention may be considered to be made up of power components, servo components, and pilot components. The power components are rotary motor 92 and linear motors 65, 66 and 160. The servo components are a plurality of servo valves 180, 181, 182 and 183, a restrictor 184, and emergency dump valve 185, pressure relief valves 186, 187 and 190 set at 1,000, 1,500 and 2,500 pounds per square inch, respectively, a spring biased cutoff valve 191, a check valve 192, and a main pump 193. The pilot components comprise a pilot pump 194, a relief valve 195 set at 200 pounds per square inch, a plurality of manually operable valves 196, 197, 200 and 201, and chain actuated valves 97, 98 and 99.

Pumps 193 and 194 are parts of pumping apparatus 25 of FIG. 1, and may be actuated by a common drive shaft 202 through a suitable clutch or other disengageable connection from the vehicle engine. The pumps are supplied with hydraulic fluid from a common reservoir 203, to which the fluid acting in the power, servo, and pilot components is returned. The hydraulic conduitry will now be traced in detail.

Pilot pump 194 draws fluid from reservoir 203 through a conduit 204 and supplies it to a pilot supply manifold 205 connected by conduits 206, 207, 210, 211, 212 and 213 to relief valve 195 and valves 196, 201, 200, 197 and 97, respectively. A pilot return manifold 214 connects to reservoir 203, and receives fluid through conduits 215, 216, 217, 218, 220, 221, 222 and 223 from relief valve 195 and valves 196, 201, 200, 197, 97, 98 and 99, respectively. Valves 191 and 196 are interconnected by a conduit 224. Conduits 225 and 226 interconnect valves 183 and 201, conduits 227 and 230 interconnect valves 180 and 197, and conduits 231 and 232 interconnect valves 182 and 200 and are extended to valves 98 and 99 by conduits 223 and 234. Valve 181 is connected to valve 97 by conduit 235.

Main pump 193 draws fluid from reservoir 203 through conduit 236 and supplies it through conduit 237 and check valve 192 to a main supply manifold 238, including an accumulator 239 and connected by conduits 240, 241, 242, 243, 244, 245 and 246 to relief valves 190 and 187 and valves 191, 185, 180, 183 and 181, respectively. Conduit 246 is tapped at 247 to restrictor 184, and valves 181 and 182 are interconnected by a conduit 250 tapped at 251 to restrictor 184. Valve 191 and relief valve 186 are connected by a conduit 252. A main return manifold 253 connects to reservoir 203, and receives fluid through conduits 254, 255, 256, 257, 260, 261 and 262 from relief valves 190, 187 and 186 and valves 185, 180, 183 and 182. Valve 180 is connected to motor 65 and 66 by conduits 263 and 264: motor 160 is connected to valve 183 by conduits 165 and 166, and motor 92 is connected to valve 182 by conduits 93 and 94.

Valves 196, 197, 200 and 201 are preferably located at 28 in the vehicle cab, where a suitable on/off control for the vacuum line 173 may also be provided. Valve 185 is preferably located in the floor of the cab for easy actuation by the operator's foot, his hands frequently being otherwise occupied. Valves 180-183 and restrictor 184 are located where convenient, like relief valves 186, 187, 190 and 195, valve 191, and accumulator 239.

Figure 12A:
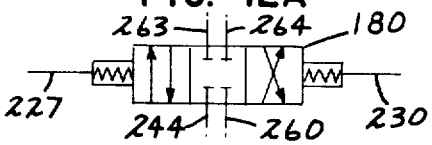
FIG. 12A to 12E give illustrative valve constructions schematically.

Valve 180 has a spring-biased central position in which no connection is made to conduits 244 and 260: see FIG. 12A. When a hydraulic signal of a first sense is supplied on conduits 227 and 230, valve 180 connects conduits 244 to conduit 263 and conduit 260 to 264, while if the hydraulic signal is reversed valve 180 connects conduit 244 to conduit 264 and conduit 260 to conduit 263. Valves 182 and 183 are similarly constructed.

Figure 12B:
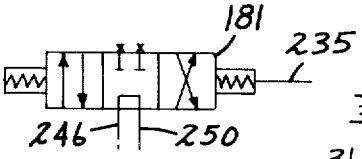

Valve 181 has a spring-biased normal position in which it connects conduit 246 to conduit 250: see FIG. 12B. When a hydraulic signal is supplied on conduit 235, the connection between conduits 246 and 250 is interrupted.

Figure 12C:
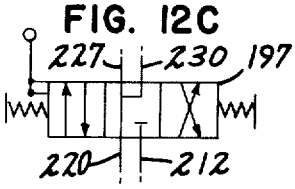

Valve 197 has a spring-biased central position in which conduits 227 and 230 connected to return manifold 220: see FIG. 12C. The valve can be manually operated into either a first position, in which conduit 220 is connected to conduit 227 and conduit 212 is connected to conduit 230, or a second position, in which conduit 220 is connected to conduit 230 and conduit 212 is connected to conduit 227. Valves 200 and 201 are similarly constructed.

Figure 12D:
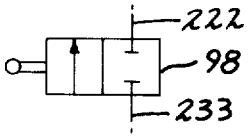
Figure 12E:
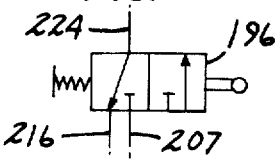
Figure 2:
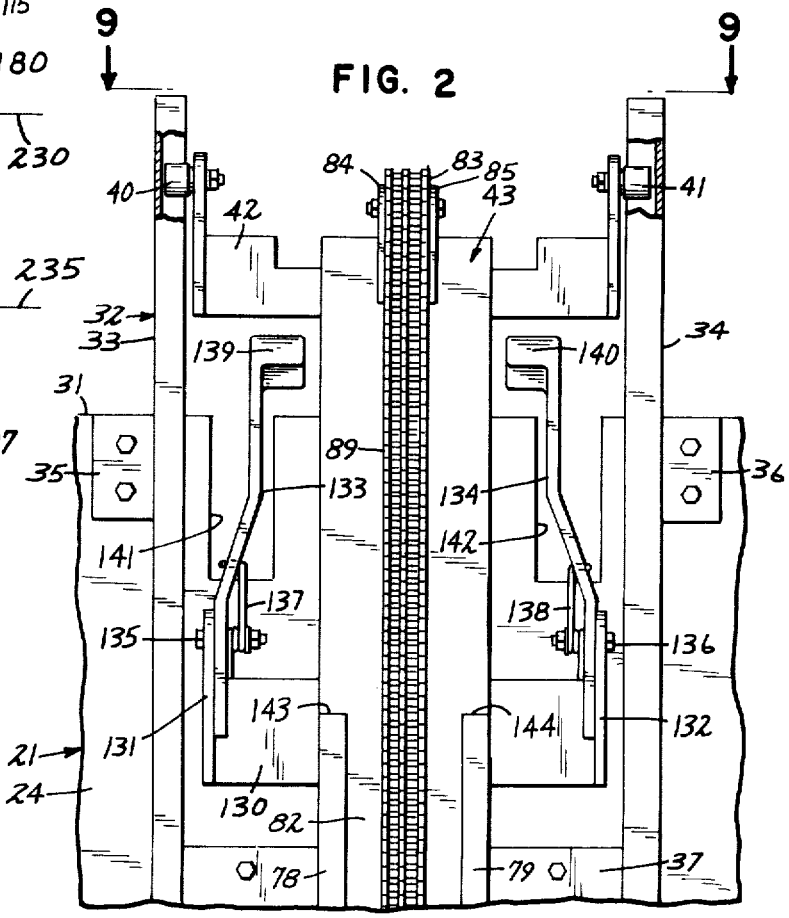
FIG. 2 is an enlarged showing of a portion of FIG. 1.

Valve 196 has a spring-biased normal position in which conduit 216 is connected to conduit 224 and no connection is made to conduit 207: see FIG. 12E. The valve can be manually operated into a second position in which conduit 207 is connected to conduit 224, and no connection is made to conduit 216. Valve 97 is similarly constructed.

Valve 98 has a spring-biased normally closed position, and may be actuated to connect conduit 233 to conduit 222: see FIG. 12D. Valve 99 is similarly constructed, being actuable to connect conduit 234 to conduit 223.

While valve 201 has for convenience been shown as located in the vehicle cab and as manually operable, it will be realized that this valve can be arranged for automatic action when a container has been operatively engaged by head 170, and for that purpose may also be located at head 170 rather than in the cab. If automatic operation is desired, it may be preferred that valve 183 have no central off position, but be always in a first operative position unless triggered to a reverse operative position, and that valve 201 be a simple 2-position reversing valve.

OPERATION

In discussing the operation of our invention, it is understood that a number of containers are positioned, at ground level, at spaced locations suitable for the reception of material to be conveyed and also suitable for ready access by vehicles. According to an agreed-on schedule, or upon call, a vehicle 20 equipped with loading apparatus 23 is brought to collect the material in the containers. During its highway travel, the equipment is in the position shown in FIG. 1, except that to reduce overall width, the pickup head is carried in the position shown in FIG. 5. It is not necessary that shaft 202 be driven by the engine at this time. Valves 180, 182, 183, 197, 200 and 201 are spring-centered to normal off position, valve 191 is in a open position, valve 196 is closed to entrance of fluid from conduit 207, but completes a path from conduit 224 to conduit 216, valve 181 is spring-centered to connect conduits 246 and 250, valve 97 is in a position to supply fluid from conduit 213 to conduit 235, valve 98 is positioned by chain 89 to connect conduit 233 with conduit 222, and valve 99 is in a position to cut off conduit 234 from conduit 223. Valves 185, 186, 187 and 190 are in their closed positions in which no flow of liquid through them can take place.

Under these conditions, track member or arm 43 is retained against the side 24 of the vehicle by hydraulic motors 65 and 66, parallel linkage 152 is maintained in its contracted position by hydraulic motor 160, and pickup head 170 is retained in position at the top of track member 43 by gravitational engagement between stop members 106, 107 and stop members 139, 140, chain motor 92 being also hydraulically locked.

As the location of a container is approached, the vehicle operator may engage shaft 202 for driving bya the vehicle engine. This builds up a pressure of 200 pounds per square inch in manifold 205, relief valve 195 opening to bypass fluid if the pressure becomes greater. Similarly, a pressure of 1,000 pounds per square inch is built up in manifold 238, being limited by relief valve 186. Since valves 197, 200 and 201 are centered, valves 180, 182 and 183 are likewise centered. However, valve 97 now supplies fluid from pilot manifold 205 through conduits 213 and 235 to valve 181, by which the connection from conduit 246 to 250 is interrupted. Power fluid can now reach valve 182 from conduit 250 only through restrictor 184.

As an easily acquired skill, the operator stops the vehicle close to the container, with loading apparatus 23 in line with it. He now activates valve 200 to complete a path from pilot manifold 205 through conduit 211, the valve, and conduit 232 to valve 182, a return path being at the same time created from valve 182 through conduit 231, valve 200, and conduit 218 to pilot return manifold 214. Valve 182 is actuated into a position in which a first connection is made between conduits 250 and 262 and conduits 93 and 94, energizing motor 92 to drive chain 89 in the direction of the solid arrow in FIG. 4, the speed of the motor being limited by the rate of flow permitted by restrictor 184. Movement of the chain actuates valve 98 into a position where a connection no longer exists between conduits 233 and 222. Continued operation of the chain drives head 171 outward over the top of the vehicle wall and begins to lower it toward the ground. At this point, valve 97 is chain actuated to disconnect conduit 235 from end of conduit 213 and connect it to conduit 221, allowing valve 181 to return to the position in which it connects conduits 246 and 250, so that the speed of motor 92 is increased although it still opposes free gravitational fall of the head along track member 43.

While the head is being lowered, along the track member, the operator may operate valve 197, connecting conduits 220 and 212 in a first sense to conduits 227 and 230, and hence operating valve 180 to connect conduits 244 and 260 in the first sense to conduits 263 and 264. This causes motors 65 and 66 to extend their actuators, moving track member 43 from the position of FIG. 3 to that of FIG. 4: valve 197 is then allowed to recenter itself. During this movement of track member 43, its upper end moves downward considerably in track means 32.

Figure 13:
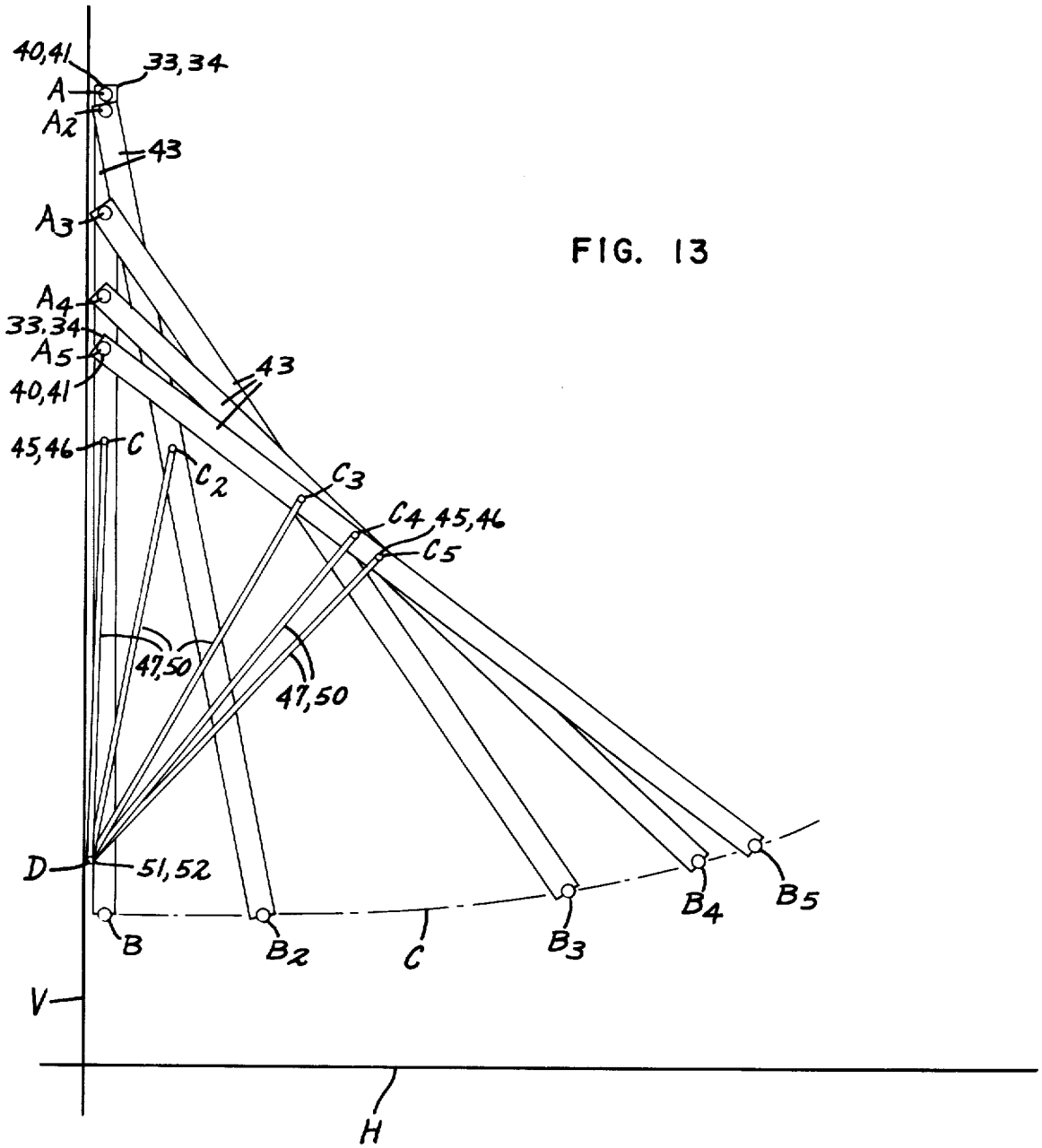
FIG. 13 is a schematic diagram illustrative of the operation of a portion of the invention.

The bottom end of the track member describes the generally horizontal curved path shown at C in FIG. 13 because of the geometrical relations involved, as given in the following table. The point A is the axis of wheels 40 and 41, B is the lowest point on the track (the horizontal tangent to chain 89 below wheel 86), C is the axis of pivots 45 and 46, and D is the axis of pivots 51 and 52.

| Point | Distance From (inches) Line V | Line H |
|---|---|---|
| A | 2 | 108 |
| $A_2$ | 2 | 105 |
| $A_3$ | 2 | 93 |
| $A_4$ | 2 | 84 |
| $A_5$ | 2 | 78 |
| D | 1 | 21 |
| B | 2 | 18 |
| $B_2$ | 14 | 18 |
| $B_3$ | 98 | 21 |
| $B_4$ | 66 | 24 |
| $B_5$ | 78 | 26 |

Near the bottom of the track extended member, plate 154 and hence head 170 are angulated considerably from the vertical, beyond any practical possibility of alignment with the side of a container. This is corrected for by causing the carriage to move part way around the lower end of the track member in lower curved guidance surface portions 124 and 125 to the position shown in FIG. 4. As the carriage reaches the point along the track member at which rollers 110 start to follow the curve, valve 97 is again chain actuated to reduce the speed of motor 92 by means of valve 181 and restrictor 184, and when the head reaches the FIG. 4 position, valve 99 operates to connect conduits 234 and 223, preventing further actuation of valve 182 which returns to its central position, disconnecting conduits 93 and 94 and hence hydraulically locking motor 92. Valve 200 may now be released and allowed to center itself.

Unless the vehicle positioning was infelicitous, the operations just described have brought head 170 very close to or in engagement with the side of the container, and vacuum-tight engagement may be consummated, either automatically or by manual use of valve 201. This presses head 171 even more firmly against container 176, ensuring pneumatic engagement thereto, and at the same time lifts the container slightly above the ground, to permit track 43 to be returned to its vertical position of FIG. 3. Valve 201 is released to center itself, valve 197 is reversely operated to return motors 65, 66 to their initial positions, and valve 200 is reversely operated to energize motor 92, to start the carriage 100 back up track member 43. The speed of motor 92 is automatically increased by valve 97 when the travel of the carriage is again straight, and continues until the carriage almost reaches the top of the track member, when valve 97 is once more actuated to reduce the speed of the motor. During the upward movement of the carriage, motor 160 is automatically or manually reversed to bring plates 154 and 153 together again, thus decreasing the moment arm of the container.

Stop members 139, 140 and 106, 107 come into engagement, and further chain movement causes carriage 100 to pivot counterclockwise about rollers 108, springs 137 allowing arms 133 to displace toward the truck body for this purpose (see FIG. 5). Just as the chain begins to carry pivotal connections 122 around sprocket wheel 83, the inversion of the container is completed, and chain actuated valve 98 connects conduit 233 to conduit 222, whereupon valve 182 centers, stopping motor 92 and hydraulically locking it. The manual valves should all now be recentered.

During the last portion of the carriage travel, when the container is being inverted, a unit of chain travel represents a much greater expenditure of power than does the same unit during the linear travel of the carriage. In this situation, the operator actuates valve 196, supplying a hydraulic signal to close valve 191. The path for liquid through relief valve 186 is now cut off, and the pressure in manifold 238 can rise to a value of 1,500 pounds per square inch, as controlled by relief valve 187. By reason of this higher pressure, the energy supplied to motor 92 per unit time, and hence the available power, are increased by approximately 50%, facilitating the container inversion process. The normal operating pressure is restored by releasing valve 196.

The container may be returned to its original position by a reversal of the lifting operation just detailed.

Relief valve 190 is supplied to act as an automatic safety release valve in case a system malfunctions. Valve 185 is provided to make this same emergency cut-out in the high pressure system available at the discretion of the operator. If he perceives an emergency, he can actuate valve 185 pedally to equalize the pressures in manifolds 238 and 253, thereby bringing all motor operation to an immediate halt.

From the foregoing, it will be evident that we have invented a new and sophisticated materials handling system characterized by greater automaticity than before, and hence greater ease of operation and speed in use and less rough treatment of containers. The system includes a new hydraulically operated loading apparatus which may be said to reach out for a container on the ground, grasp it pneumatically, lift it along side of the vehicle to the open top thereof, invert it into the vehicle, and replace it in its initial position.

Numerous characteristics and advantages of our invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

We claim:

1. Material handling apparatus comprising, in combination:

a vehicle having a body with a top opening;

a generally vertical track member pivoted about a vertically movable horizontal axis near the top of said body, and including first and second pairs of guidance surfaces;

a carriage member movable along said track member and including container engaging means;

drive means including an endless chain for reversibly causing movement of said carriage member along said track member between a lower extreme position and an upper extreme position;

container engaging means;

mounting means securing said container engaging means on said carriage for a limited lifting extension and lowering retraction with respect thereto;

reversible means for supporting said track member and causing pivotal movement thereof to extend said mounting means so as to bring said container engaging means into engagement with a container resting on the ground;

means releasably operable to maintain said engagement;

and reversible means including said track member for causing pivotal movement of said carriage, at the upper extreme position thereof, whereby an engaged container is inverted into said body.

2. Apparatus according to claim 1 in which said pairs of guidance surfaces are generally parallel, mutually spaced laterally, and partially overlapping, at least one of said pairs having inwardly curved extremities at first ends thereof;

and in which said rollers are in pairs on laterally spaced axes and arranged severally to engage said pairs of guidance surfaces.

3. In combination:

a track member including first and second pairs of spaced guidance surfaces which are generally parallel and mutually displaced laterally to define a pair of parallel paths for linear movement;

a carriage member movable along said track member and having first and second pairs of rollers, on spaced axes, engaging said surfaces so that when said surfaces extend rectilinearly a portion of said carriage member remains parallel to itself as said carriage moves;

first stop means fixed with respect to said track member and path of said carriage member;

second stop means carried by said carriage member for engaging said first stop means in mutually pivotable relation, to first arrest said movement of said carriage member along said track member and thereafter afford relative pivotal movement therebetween accompanied by transitory transverse displacement of said stop means relative to said parts;

a drive chain reversibly moving along said track member;

link means including at least one link having a first end pivotally connected to said chain and a second end pivotaly connected to said carriage member, about an axis parallel to said spaced axes and displaced therefrom to lie on the opposite side of said chain, for a normally causing translation of said carriage member along said track member, said link means acting when said stop means become engaged to cause rotation of said carriage member with respect to said track member, about one of said spaced axes;

and means arresting the motion of said carriage member after a predetermined extent of rotation thereof.

4. The structure of claim 3 together with means at lower end portions of one pair of said guide surfaces for receiving the associated rollers and guiding them along a circular path, whereby to cause said portion of said carriage member to move out of parallelism with its former positions.

5. In combination:

a track member including first and second pairs of spaced guidance surfaces which are generally parallel and mutually displaced laterally to define a pair of parallel paths for linear movement;

a carriage member movable along said track member and having first and second pairs of rollers, on spaced axes, engaging said surfaces so that when said surfaces extend rectilinearly a portion of said carriage member remains parallel to itself as said carriage moves;

an endless chain reversibly movable along said track member;

first stop means linearly fixed with respect to said track member and in the path of said carriage member limiting the travel thereof but resiliently deplaceable laterally from said track member;

second stop means carried by said carriage member for engaging said first stop means in mutually pivotable relation, to first arrest movement of said carriage member along said track member and thereafter afford relative pivotal movement therebetween;

link means including at least one link having a first end pivotally connected to said chain and a second end pivotally connected to said carriage member, about an axis parallel to said spaced axes and displaced therefrom to lie on the opposite side of said chain, for normally causing translation of said carriage member along said track member, said link means acting when said stop means become engaged to cause rotation of said carriage with respect to said track member, about one of said spaced axes, the guidance surface associated with the other of said spaced axes terminating longitudinally to afford clearance for this rotation;

and means arresting the motion of said carriage member after a predetermined extent of rotation thereof.

6. In combination:

a vehicle having a body with a top opening;

vertical track means secured to the outside of said body near the rim of said top opening;

lever means including at least one lever pivotally connected to said vehicle below said body;

motor means pivotally connected to said vehicle and to a fulcrum point along said lever and reversibly actuable horizontally to pivot said lever means with respect to said body;

a support member pivotally connected to said lever at a location beyond said fulcrum point;

an elongated track member secured transversely to said support member, and having at an upper end wheel means guided by said track means, so that operation of said motor means varies the angulation of said track member relative to said body;

a carriage member movable along said track member;

and driving means carried by said track member for causing movement of said carriage member therealong.

* * * * *